US005246177A

United States Patent [19]

Sugioka

[11] Patent Number: 5,246,177

[45] Date of Patent: Sep. 21, 1993

[54] YARN WINDING APPARATUS OF AN AUTOMATIC BOBBIN CHANGING TYPE

[75] Inventor: Takami Sugioka, Matsuyama, Japan

[73] Assignee: Teijin Seiki Co., Ltd., Osaka, Japan

[21] Appl. No.: 975,965

[22] Filed: Nov. 13, 1992

Related U.S. Application Data

[63] Continuation of Ser. No. 742,406, Aug. 8, 1991, abandoned.

[30] Foreign Application Priority Data

Aug. 8, 1990 [JP] Japan ..... 2-209777
Jun. 26, 1991 [JP] Japan ..... 3-182060

[51] Int. Cl.[5] ..... B65H 67/044
[52] U.S. Cl. ..... 242/1800 A
[58] Field of Search ..... 242/18 A, 25 A, 56 A, 242/56 R, 64

[56] References Cited

U.S. PATENT DOCUMENTS

| | | | |
|---|---|---|---|
| 2,789,774 | 4/1957 | Petersen et al. | 242/18 A |
| 3,999,715 | 12/1976 | Schippers et al. | 242/18 A |
| 4,298,171 | 11/1981 | Fluckiger et al. | 242/18 A |
| 5,029,762 | 7/1991 | Behrens et al. | 242/18 A |
| 5,046,224 | 9/1991 | Bogucki-Land et al. | 242/56 A |

FOREIGN PATENT DOCUMENTS

| | | | |
|---|---|---|---|
| 874945 | 4/1953 | Fed. Rep. of Germany | 242/18 A |
| 2364284 | 4/1975 | Fed. Rep. of Germany . | |
| 2365384 | 5/1975 | Fed. Rep. of Germany . | |
| 2065654 | 7/1976 | Fed. Rep. of Germany . | |
| 199091 | 10/1965 | Sweden | 242/18 A |

*Primary Examiner*—Stanley N. Gilreath
*Attorney, Agent, or Firm*—Rothwell, Figg, Ernst & Kurz

[57] ABSTRACT

A path for guiding bobbin holders (7, 8) is formed in a closed loop shape on a machine frame (1), inner gear members (65, 66) are spaced in an axial direction of the bobbin holders (7, 8) and disposed along the bobbin holders guiding path. Two bobbin holders (7, 8) are supported on sliders (13, 14), respectively, and gear wheels (67*a*, 67*b*, 68*a*, 68*b*, 69*a*, 69*b*, 70*a*, 70*b*) disposed at the support portions of the bobbin holders (7, 8) engage with the inner gear members (65, 66). Two endless chains (82, 83) are spaced in an axial direction of the bobbin holders (7, 8) and disposed along the bobbin holders guiding path. The chains (82, 83) are connected to the bobbin holders (7, 8), respectively, whereby the bobbin holders (7,8) can be independently moved along the bobbin holders guiding path formed to locate a winding position, a doffing position, an empty bobbin donning position, a stand by position and a bobbin changing position.

13 Claims, 13 Drawing Sheets

YARN WINDING APPARATUS OF AN AUTOMATIC BOBBIN CHANGING TYPE

This is a continuation of U.S. patent application Ser. No. 07/742,406, filed Aug. 8, 1991, now abandoned.

The present invention relates to an apparatus of a bobbin changing type for winding a yarn, such as a synthetic yarn, at a high speed.

More specifically, the present invention relates to a yarn winding apparatus of an automatic bobbin changing type, which is provided with a plurality of bobbin holders, and in which when a package wound on one of the bobbin holders becomes a predetermined amount, winding of the yarn is changed to another bobbin on the other bobbin holder.

Conventionally, bobbin winding apparatus of a turret type have been widely used, wherein a turret table formed in a circular disc is supported turnably about a central axis of the disc, and a plurality of bobbin holders are rotatably mounted on the equidistantly spaced positions on the turret table so that yarn winding onto a bobbin holder to another bobbin holder is changed by turning the turret table together with the bobbin holders.

In such a conventional bobbin winding apparatus of a turret type, the positional relationship between the turret table and the plurality of bobbin holders mounted on the turret table, and accordingly, the mutual locational relationship between the bobbin holders are kept unchanged while the turret table is turned. Accordingly, the distance between the bobbin holders is required to be at least a distance D, which is obtained by adding a clearance C between an empty bobbin and a full package to a half of sum of a diameter $D_0$ of an empty bobbin and a diameter $D_f$ of a fully wound yarn package, i.e., D must be equal to or larger than $C+(D_0+D_f)/2$. As a result, there is a disadvantage that the size, i.e., both the height and the width, of the winding apparatus become large.

Further, when the turret table is turned, a circular space, the diameter $D_c$ of which is obtained by adding the diameter $D_0$ of an empty bobbin, the diameter $D_f$ of a fully wound yarn package, and a size $D_b$ of bearings supporting the turret table, i.e., $D_c$ is equal to $D_0+D_f+D_b$. Thus, there is another disadvantage that installing space between adjacent winding apparatus becomes large.

In addition, in an automatic bobbin changing yarn winding apparatus of a revolving type which is provided with a contact roller connected to no driving source, the contact roller becomes free from driving force during turret operation until an empty bobbin, which has stood by, comes in contact with the contact roller after a package, onto which a yarn has been wound, goes away from the contact roller. For example, the contact roller is free for about 3 minutes. Thus, the rotational speed of the contact roller decreases during the turret operation, and the may be slack and may be broken. Further, the rotational speed of the contact roller does not completely recover its original speed even when a bobbin holder with a empty bobbin comes in contact with the contact roller. As a result, a yarn caught by the empty bobbin may be slack and may be broken, and the quality in a yarn at a transfer tail portion or at an inner portion of the wound package may be uneven.

Furthermore, in the above-described bobbin winding apparatus of a turret type, a yarn, extending from the contact roller to the wound package, contacts with the surface of the empty, bobbin forming a large contacting angle therebetween, when the fully wound package is changed. Accordingly, the yarn may be slack, and consequently, bobbin changing efficiency may be lowered.

It is an object of the present invention to provide a yarn winding apparatus of a bobbin changing type, by which the disadvantages inherent to the conventional yarn winding apparatus of an automatic bobbin changing type can be obviated or minimized and which requires minimum space for installing the same.

It is another object of the present invention to provide a yarn winding apparatus of a bobbin changing type by which the time, which is required between the relief of a fully wound package from a contact roller and the contact of an empty bobbin to the contact roller during the changing operation, can be shortened. This is so even when the present invention is applied to an automatic bobbin yarn winding apparatus provided with a contact roller connected to no driving source, and accordingly, the variation in rotational speed of the contact roller during the changing operation can be minimized.

It is still another object of the present invention to provide a yarn winding apparatus of a bobbin changing type, which is provided with a mechanism with high rigidity for always supporting bobbin holders, onto which yarns are wound, in parallel to the contact roller.

According to the present invention, the above-described objects are achieved by a yarn winding apparatus of an automatic bobbin changing type, which is provided with a plurality of bobbin holders, and in which when a package wound on one of the bobbin holders becomes a predetermined amount, winding of the yarn is changed to another bobbin holder, characterized in that the yarn winding apparatus comprises:

a path formed along a closed loop for guiding the plurality of bobbin holders along a winding position, a doffing position, an empty bobbin donning position, a stand-by position, a changing position and the winding position: and a means for independently moving the plurality of bobbin holders along the bobbin holders guiding path.

According to the present invention, since a plurality of bobbin holders can be moved independently along the bobbin holders guiding path, the space required for installation of the winding apparatus is a sum of a diameter of a fully wound package and a diameter of an empty bobbin. As a result, the required space can be about ¾ of that required for a conventional yarn winding apparatus of a turret type.

Furthermore, when the present invention is applied to an automatic bobbin changing yarn winding apparatus provided with a contact roller connected to no driving source, a stand-by bobbin holder can be located near the contact roller previous to the changing operation, since a bobbin holder having an empty bobbin mounted thereon can be moved independently from another bobbin holder having a fully wound package mounted thereon. Therefore, the time which is required between the relief of a fully wound package from a contact roller and the contact of an empty bobbin to the contact roller can be shortened. As a result, the rotational speed of the contact roller can be kept at a substantially constant speed during the changing operation.

Furthermore, since a plurality of bobbin holders can be independently moved according to the present invention, the angle formed by the yarn contacting with an empty bobbin can be smaller compared with that in the conventional bobbin winding apparatus of a turret type, while the direction of the peripheral speed of an empty roller is opposite to the yarn running direction. Accordingly, the yarn can be prevented from being slack at a high speed, and fluffs in the yarn can be minimized, and further, bobbin changing efficiency can be enhanced.

The present invention will now be explained with reference to the accompanying drawings, wherein:

FIG. 1(*b*) is a side view of FIG. 1(*a*);

FIG. 2(*b*) is a side view of FIG. 2(*a*);

FIG. 3(*b*) is a side view of FIG. 3(*a*):

FIG. 4(*b*) is a side view of FIG. 4(*a*);

FIG. 5(*b*) is a side view of FIG. 5(*a*);

FIG. 6(*b*) is a side view of FIG. 6(*a*);

FIG. 8(*b*) is a side view of FIG. 8(*a*);

Figure 1B:
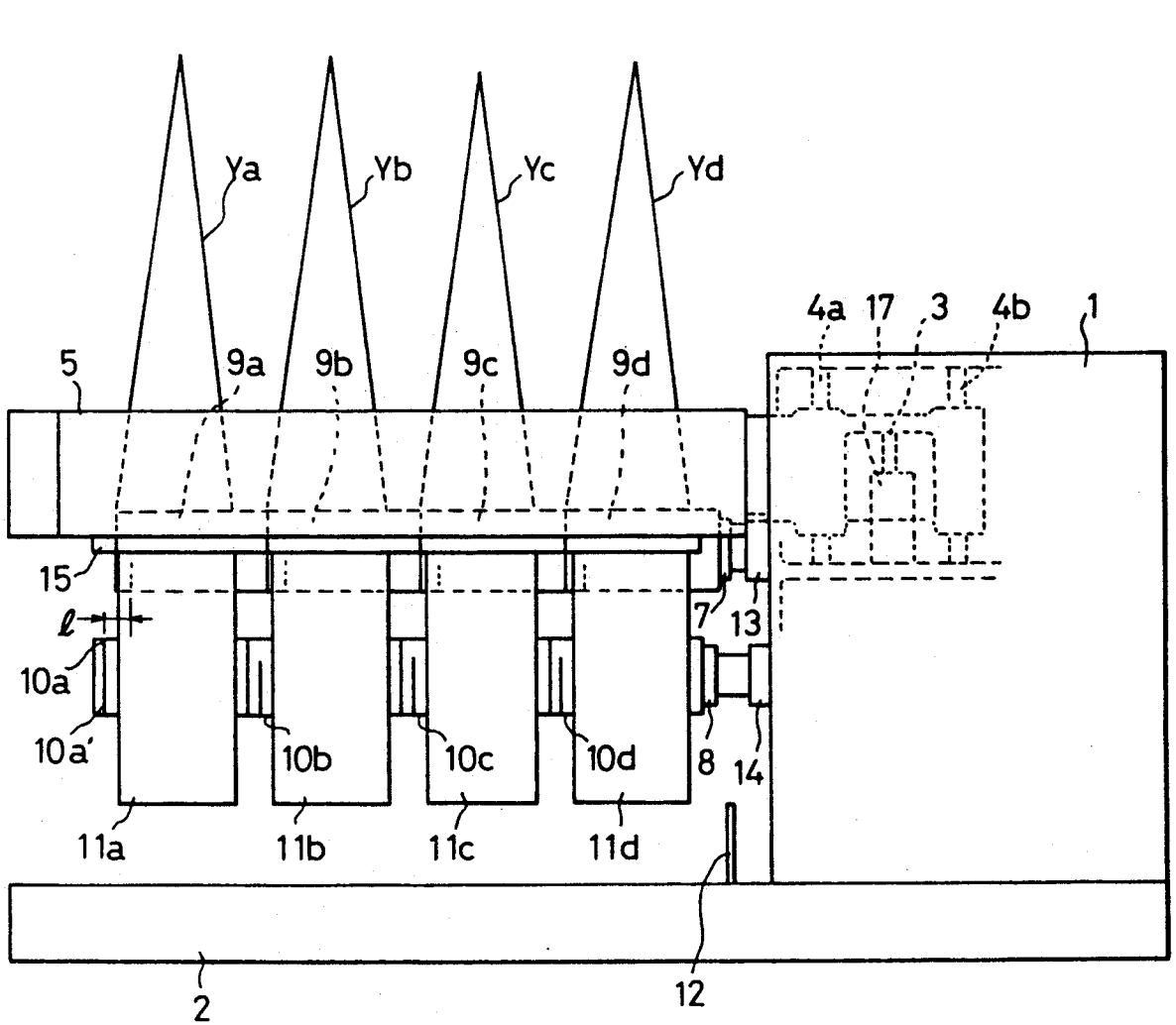
FIG. 1(*a*) is an elevation showing a bobbin changing step of an embodiment of the present invention which is applied to an automatic bobbin changing winding apparatus of a spindle drive type.
Figure 1A:
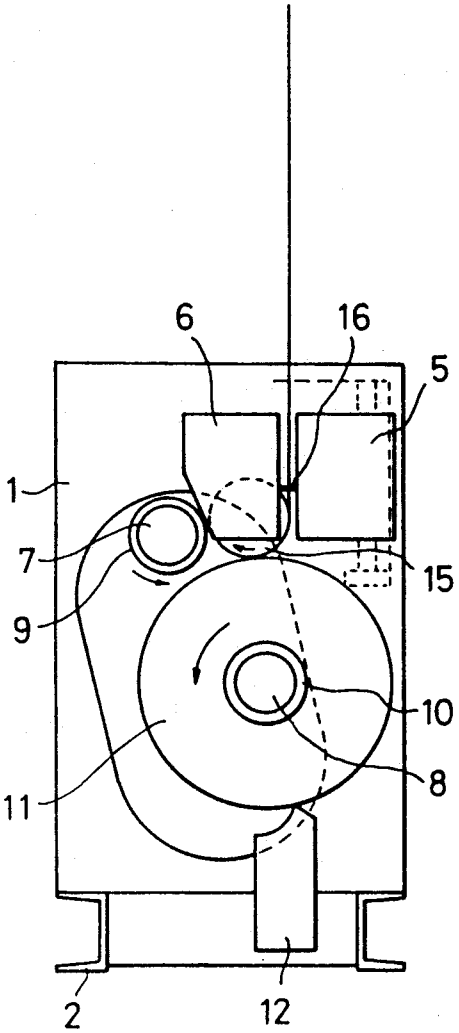
Figure 7:
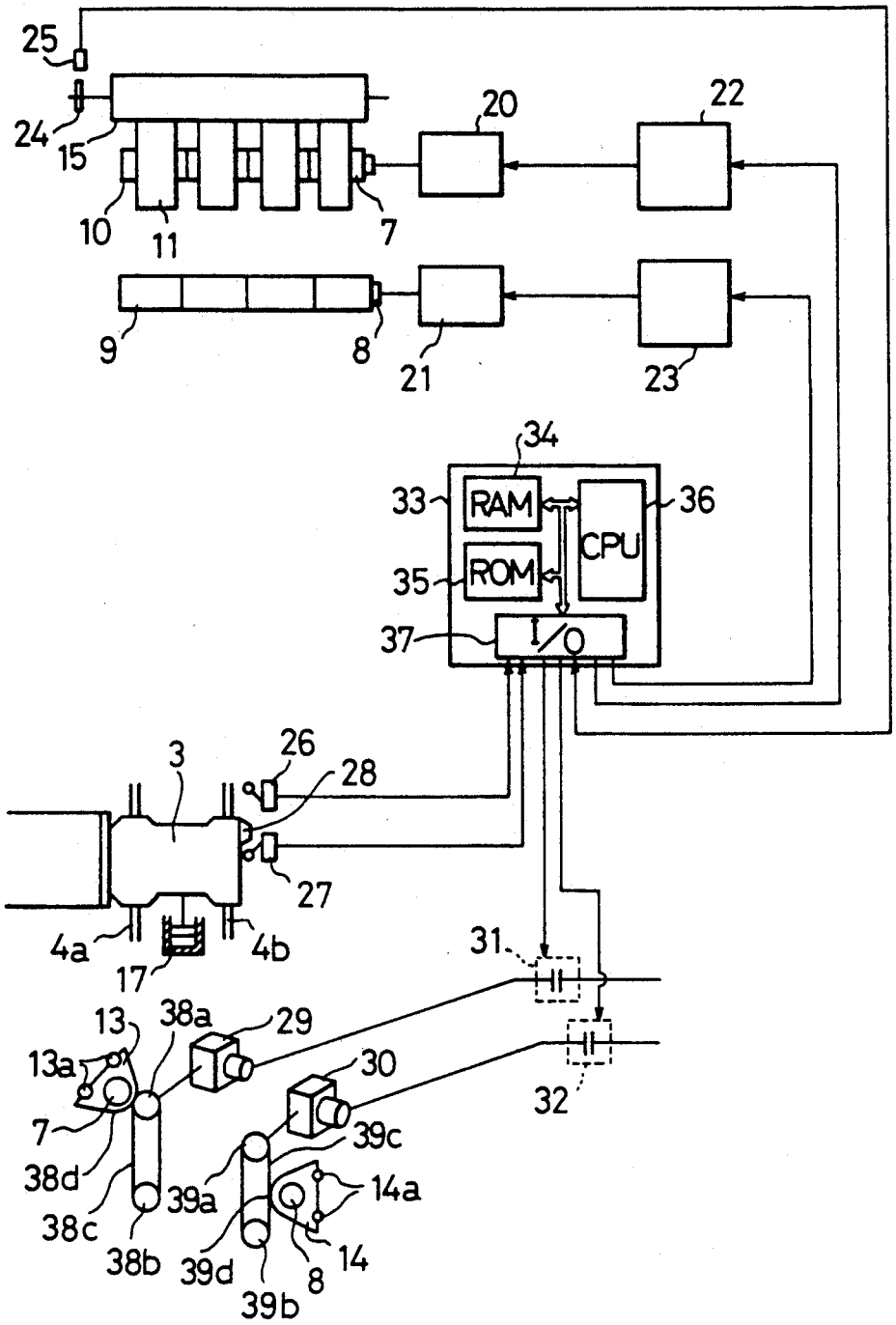
FIG. 7 is a diagram showing the driving system of the embodiment illustrated in FIGS. 1(*a*) to 6(*b*)

FIGS. 1(*a*) to 6(*b*) sequentially show bobbin changing steps of an embodiment of the present invention which is applied to an automatic bobbin changing winding apparatus of a spindle drive type, and figures designated by (a) are elevations while figures designated by (b) are side views. In the illustrated embodiment, four bobbins, which are made of paper, are inserted onto each bobbin holder so that four yarn packages are simultaneously formed on the bobbins. In the figures designated by (b), suffixes a to d are added to reference numerals used in figures with (a) so as identify the individual parts. FIG. 7 is a diagram showing driving system of the embodiment.

Referring to FIGS. 1(*a*) to 6(*b*), a machine frame 1 of an automatic bobbin changing winding apparatus of a spindle drive type according to an embodiment of the present invention is disposed on a base 2 which comprises a pair of steel channels. The machine frame 1 has a slide block 3 vertically slidably mounted thereon via stroke bearings 4*a* and 4*b* FIGS. 1(*b*) and 7). The slide block 3 has a traverse device 5 and a frame 6 for a contact roller 15 mounted thereon.

The traverse device traverses yarns Ya to Yd to and fro by means of traverse guides 16. The frame 6 rotatably supports the contact roller 15.

Bobbins 9*a* to 9*d* are inserted onto a bobbin holder 7, which is located at a stand-by position in FIG. 1, and bobbins 10*a* to 10*d* are inserted onto a bobbin holder 8, which is used to wind yarn in FIG. 1, to form packages 11*a* to 11*b* onto the bobbins 10*a* to 10*d*.

A plate 12 is moved in parallel with the bobbin holder 8 by means of a fluid pressure cylinder (not shown) so as to push out the packages 11*a* to 11*d*.

The bobbin holder 7 is supported on a slider 13, and the bobbin holder 8 is supported on a slider 14. The sliders 13 and 14 have cam followers 13*a* and 14*a*, respectively, mounted thereon. The cam followers 13*a* and 14*a* are movably supported so that they engage with guide grooves (not shown) which are formed in the machine frame.

A plate 19 for disengaging a yarn is swingably supported above the traverse device 5 and is swung by means of a fluid pressure cylinder (not shown).

A fluid pressure cylinder 17 (see FIGS. 1(*b*) and 7) is connected to the slide block 3 so that the weight of the slide block 3, having the traverse device 5 and the contact roller 15 mounted thereon, is supported by the fluid pressure cylinder 17 and a predetermined contact pressure is exerted to the packages 11 by the contact roller 15.

Figure 2B:
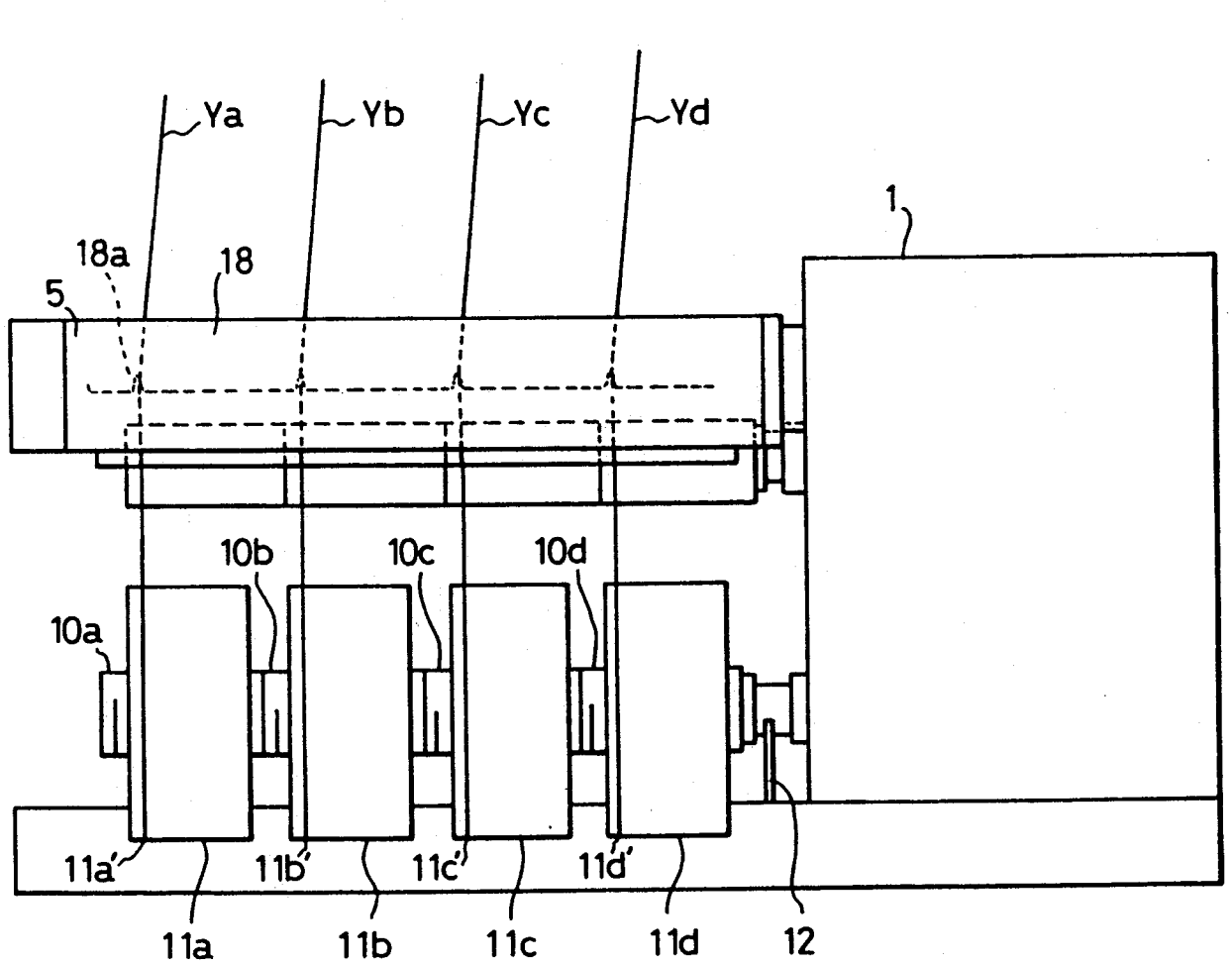
FIG. 2(*a*) is an elevation showing a step subsequent to that illustrated in FIG. 1(*a*) and FIG. 1(*b*)
Figure 2A:
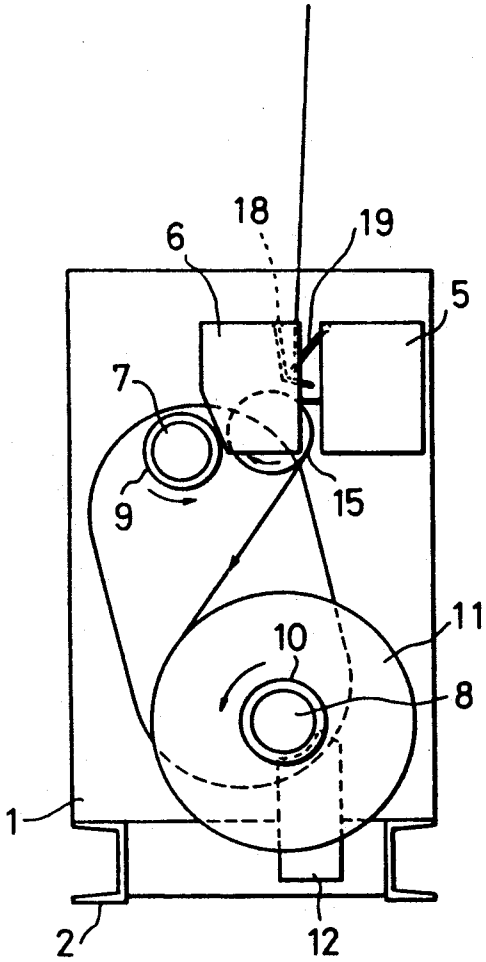

A yarn gathering guide 18 is so disposed on the frame 6 that it faces the yarn disengaging plate 19, and it has yarn positioning recesses 18*a* formed thereon as illustrated in FIG. 2(*b*).

Electric motors 20 and 21 are connected to the bobbin holders 7 and 8, respectively (see FIG. 7), and the motors 20 and 21 are communicated with inverters 22 and 23, respectively.

As illustrated in FIG. 7, a gear wheel 24 is fixed to an end of the contact roller 15, and the rotational speed of the contact roller 15 is detected by an electro-magnetic pickup 25 which is disposed on the machine frame, and faces the gear wheel 24.

The slide block 3 has a knocker 28 which is capable of engagement with limit switches 26 and 27. The limit switch 26 detects the upper limit of the slide block 3 and the limit switch 27 detects the lower limit of the slide block 3.

In FIG. 7, an endless chain 38*c* is wrapped around a pair of sprockets 38*a* and 38*b*, which are vertically spaced. The endless chain 38*c* is connected to the slider 13, which supports the bobbin holder 7, via a joint 38*d*. The joint 38*d* is connected to a reduction device 29 with worm gear. Accordingly, when the reduction device 29 with worm gear is rotated, the sprocket 38*a* is rotated, and thus, the endless chain 38*c* moves with the slider 13 along a path formed in a track shape around the sprockets 38*a* and 38*b*, and the slider posture.

Similarly, an endless chain 39*c* is wrapped around a pair of sprockets 39*a* and 39*b*, which are vertically spaced. The endless chain 39*c* is connected to the slider 14, which supports the bobbin holder 8 via a joint 39*d*. The joint 39*d* is connected to a reduction device 30 with worm gear. Accordingly, when the reduction device 30 with worm gear is rotated, the sprocket 39*a* is rotated, and thus, the endless chain 39*c* moves with the slider 14 along a path formed in a track shape around the sprockets 39*a* and 39*b*, and the slider 14 is controlled by the cam follower 14*a* to a predetermined posture.

Although the endless chains 38*c* and 39*c* are horizontally separated in FIG. 7, it is preferred that the sprockets 38*a* and 39*b* are disposed coaxially and that the sprockets 38*b* and 39*b* are also coaxially disposed so that the endless chains 38*c* and 39*c* form paths overlapping in an axial direction. In this case, it is preferred that one of the reduction devices 29 and 30 is connected to one of the sprockets 38*a* and 39*a* through a hollow spindle.

An embodiment, wherein two paths overlap in an axial direction, will be explained later with reference to FIGS. 9 to 13.

The reduction devices 29 and 30 with worm gear are communicated with electro-magnetic relays 31 and 32, respectively, so that the electric source of the reduction devices 29 and 30 is switched on and off based on demands from a computer 33.

The computer 33 comprises a random access memory (RAM) 34, a read only memory (ROM) 35, central processing unit (CPU) 36 and an input port (I/0) 37.

The bobbin changing steps of the embodiment of the yarn winding apparatus of a bobbin changing type will now be explained.

The bobbin holder 7 is standing by at a position away from the bobbin holder 8, onto which yarns are being wound, towards the inside in an axial direction by a distance 1 as shown in FIG. 1(*b*). In this condition, the motor 21 is driven through the inverter 23, and the packages 11 are formed on the bobbins 10 inserted onto the bobbin holder 8.

When the amount of the packages 11 reaches a predetermined value, the motor 20 is started through the inverter 22, and the bobbin holder 7 is rotated.

When the rotational speed of the bobbin holder 7 reaches a predetermined value, i.e., 1.02 to 1.2 times of the normal winding speed, the rotational speed of the bobbin holder 8 is enhanced to 1.02 to 1.1 times of the normal winding speed, and the bobbin holder 8 is moved to a position illustrated in FIG. 2(*a*) by means of the reduction device 30 with worm gear. At the same time, the yarn disengaging plate 19 is swung by means of a fluid cylinder (not shown), and the yarns Y, which have been traversed to and fro, are disengaged from the traverse guides 16 and are engaged with the yarn positioning recesses 18*a* formed on the yarn gathering guide 18. Thus, the yarns Y are held at positions corresponding to yarn catching grooves 9*a*' to 9*d*', which are formed on the bobbins 9 inserted onto the standing by bobbin holder 7. The yarns Y are wound onto the packages 11, and bunch windings 11*a*' to 11*d*' are formed as illustrated in FIG. 2(*b*).

Figure 3B:
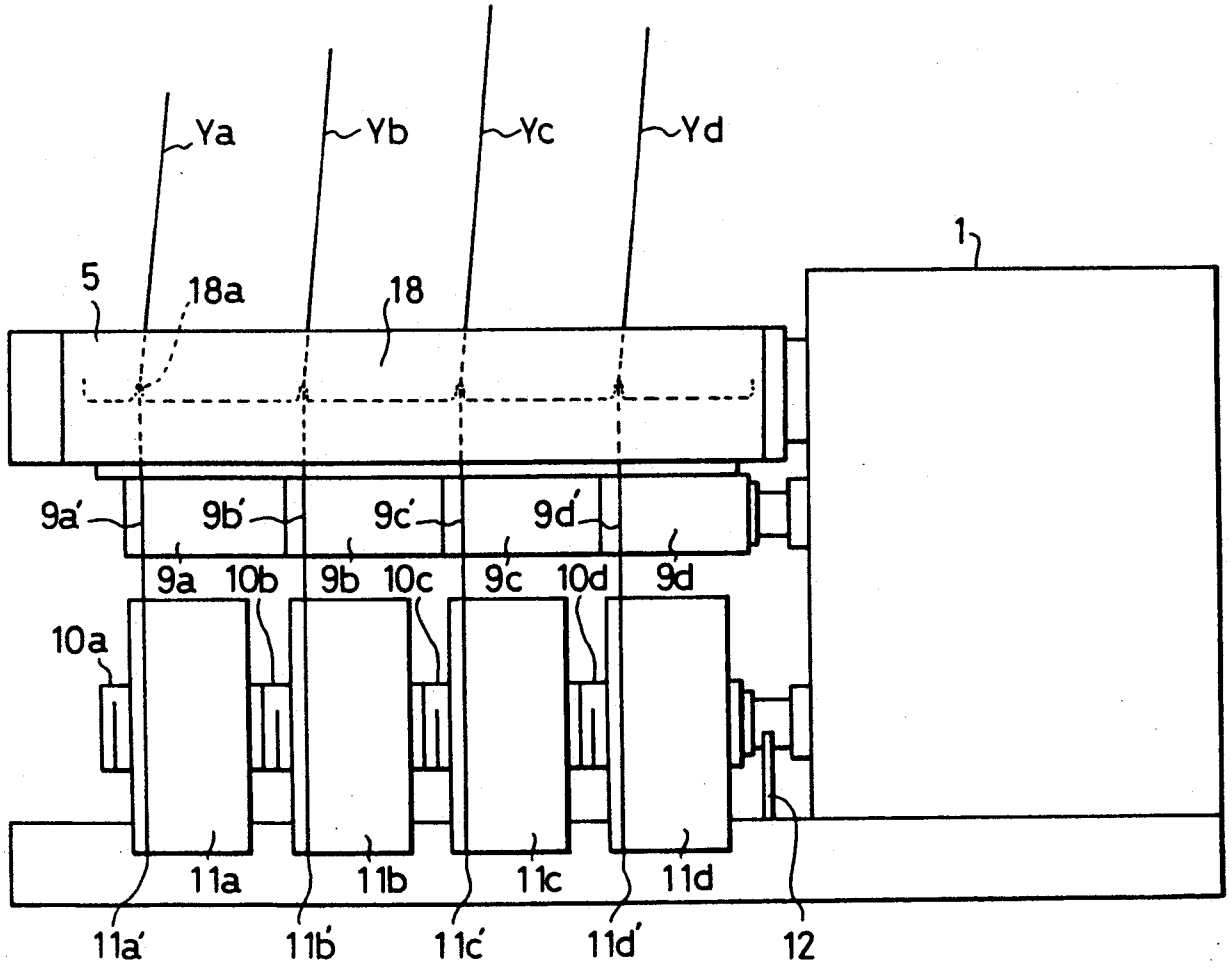
FIG. 3(*a*) is an elevation showing a step subsequent to that illustrated in FIG. 2(*a*) and FIG. 2(*b*)
Figure 3A:
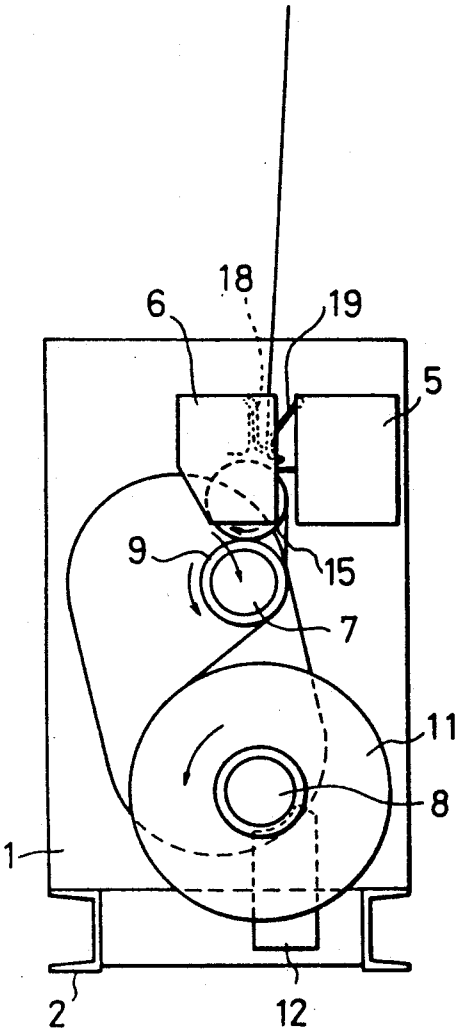

Then, as illustrated in FIG. 3(*a*), the bobbin holder 7 is moved along the track shaped path by means of the reduction device 29 with worm gear, and the yarns Y are caught by the yarn catching grooves 9*a*' to 9*d*' of the bobbins 9*a* to 9*d* as illustrated in FIG. 3(*b*). Thus, bunch windings of a slight amount are formed on the yarn catching grooves 9*a*' to 9*d*'.

When the bobbin holder 7 is moved, the contact roller 15 is to be kept in contact with the bobbin holder 7 while it is lifted by the fluid pressure cylinder 17.

Figure 4:
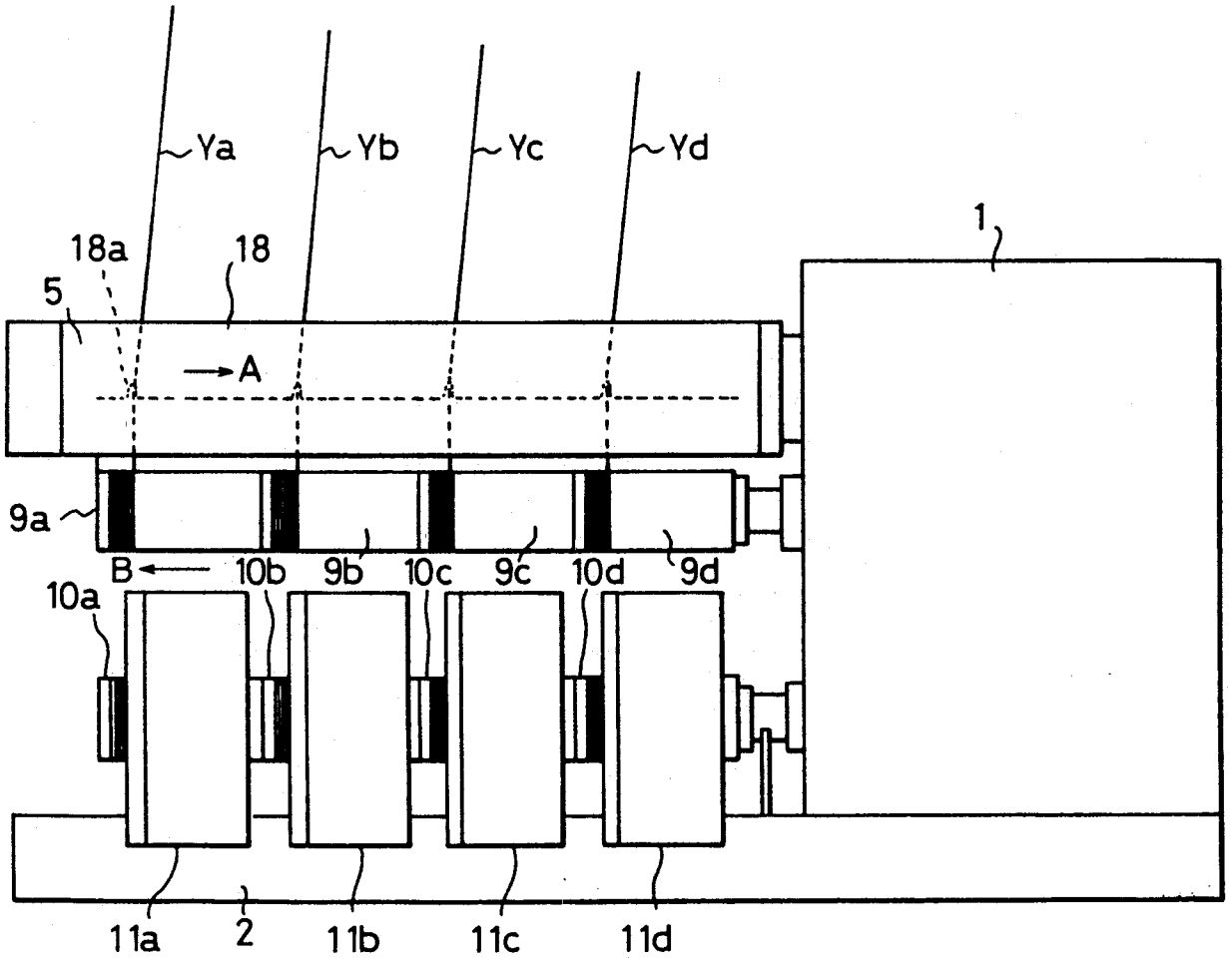
FIG. 4(*a*) is an elevation showing a step subsequent to that illustrated in FIG. 3(*a*) and FIG. 3(*b*)
Figure 4:
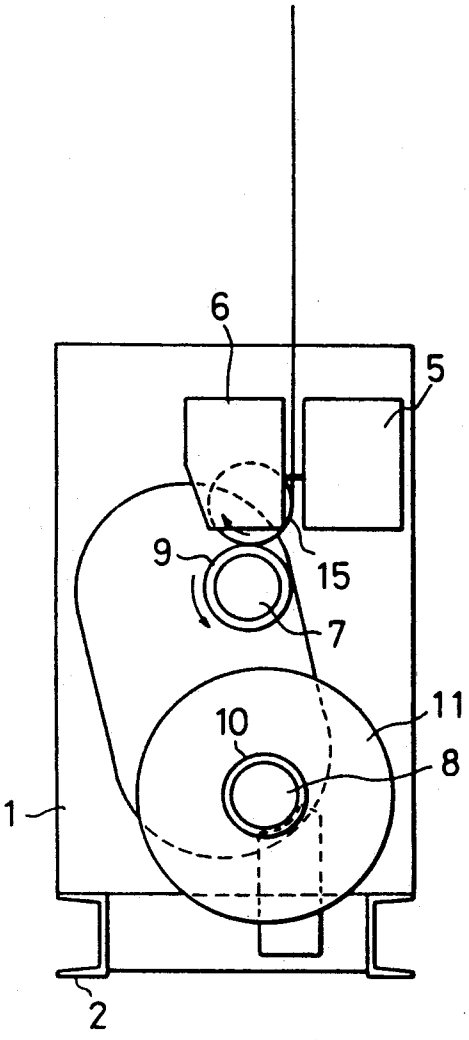

Thereafter, as illustrated in FIG. 4(*b*), the yarn gathering guide 18 is moved by a fluid pressure cylinder (not shown) to the right as indicated by an arrow A, and at the same time, the bobbin holder 7 is moved by another fluid pressure cylinder (not shown) to the left as indicated by an arrow B. Thus, transfer tails are formed on the bobbins 9, and then the yarn disengaging plate 19 is returned to its original position.

After the yarns Y are caught by the traverse guides 16, the traverse motion by the traverse guides 16 starts, and packages 9 are formed on the bobbins 9.

After the yarns Y are transferred from the packages 11, which have been wound on the bobbins 10 inserted onto the bobbin holder 8, to the bobbins 9, inserted onto the bobbin holder 7, the bobbin holder 8 is braked.

Figure 5B:
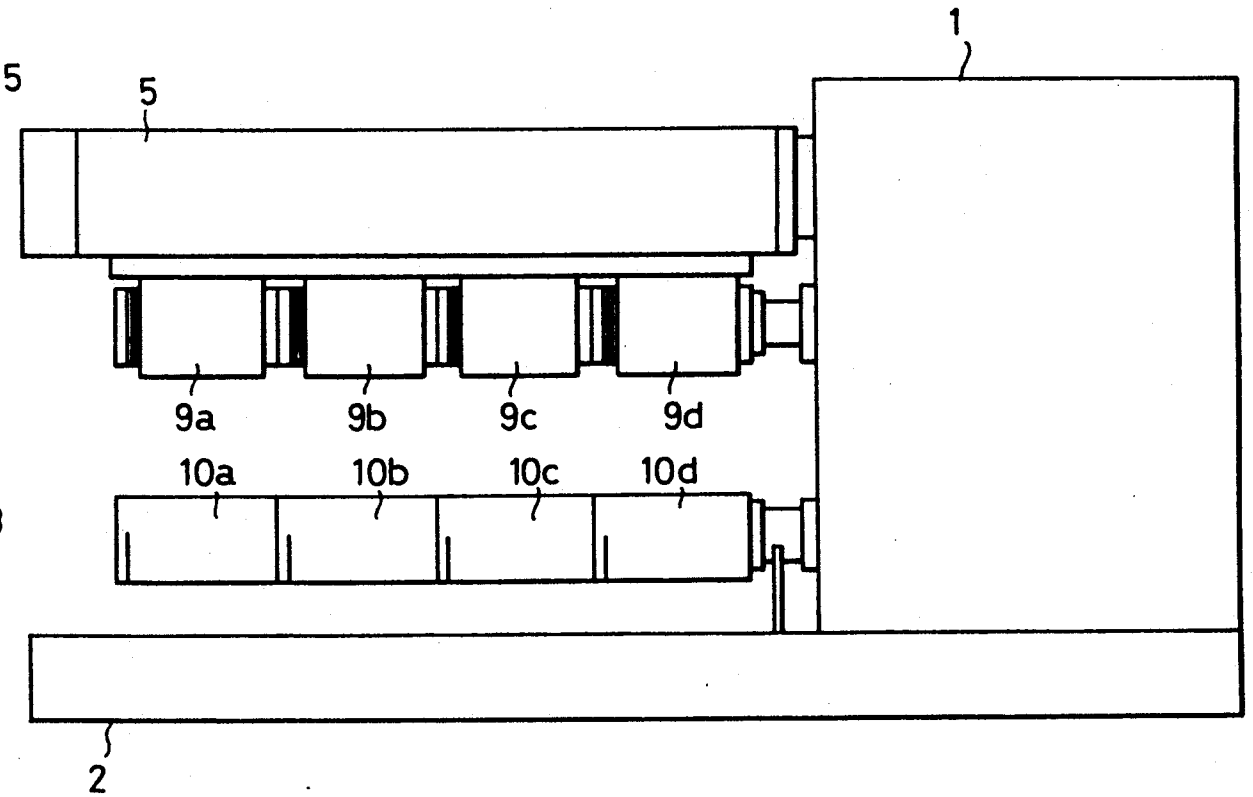
FIG. 5(*a*) is an elevation showing a step subsequent to that illustrated in FIG. 4(*a*) and FIG. 4(*b*)
Figure 5A:
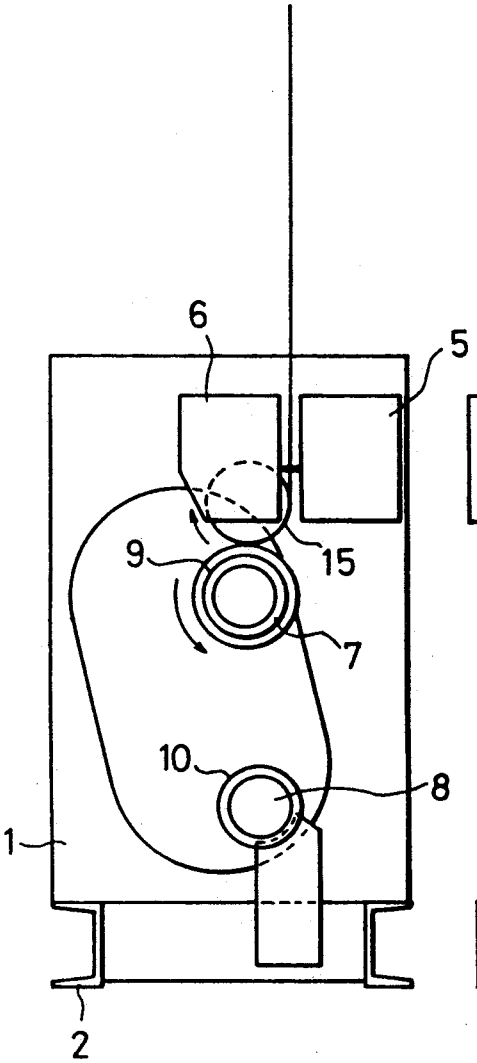

After the bobbin holder 8 stops, the chucking of the bobbins 10 is released by operating a push button. The packages 11 are pushed out by the package pushing plate 12 in an axial direction of the bobbin holder 8 and are removed from the bobbin holder 8. Then, new empty bobbins 10 are inserted onto the bobbin holder 8 and are chucked (see FIG. 5).

Figure 6B:
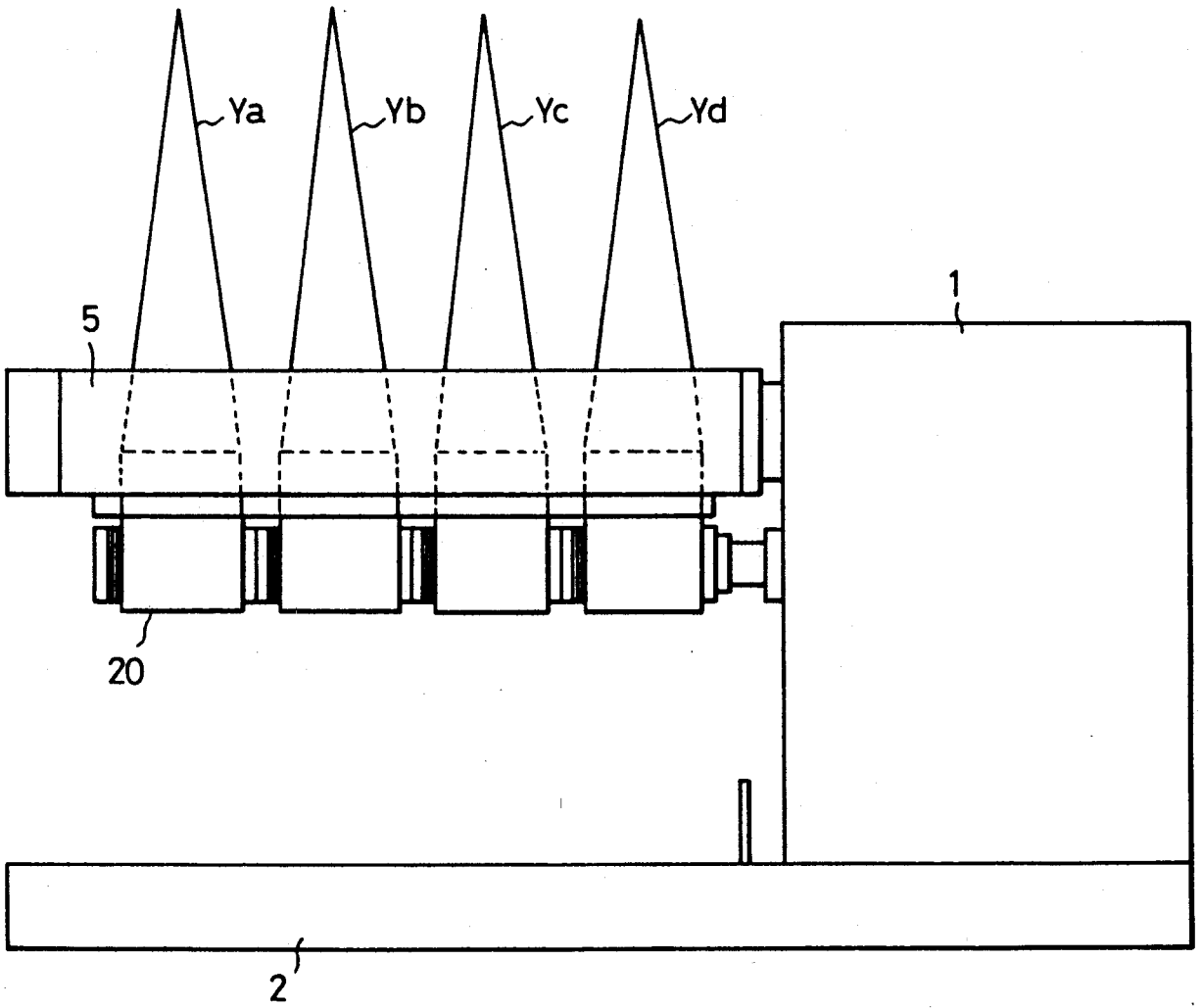
FIG. 6(*a*) is an elevation showing a step subsequent to that illustrated in FIG. 5(*a*) and FIG. 5(*b*)
Figure 6A:
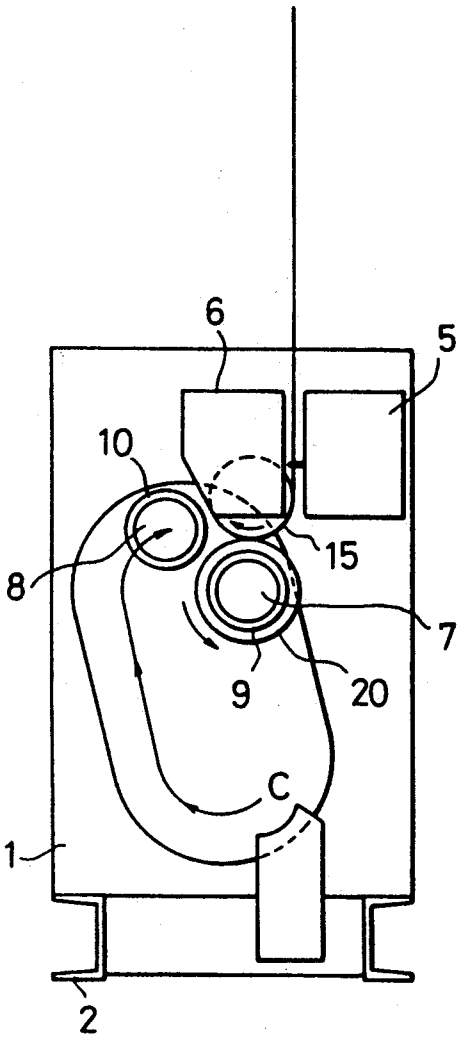

When the bobbins 10 are chucked, the bobbin holder 8 is moved at once from the doffing and donning position, which has been described above, to a stand-by position as indicated by an arrow C in FIG. 6(*a*), and the bobbin holder is axially moved by a distance 1. The bobbin holder 8 waits at the stand by position until the bobbins on the bobbin holder 7 become full. Then, the yarn gathering guide 18, which has been moved to the right, is returned to the left and stands by there.

When the packages 20, which are wound on the bobbins 9 inserted onto the bobbin holder 7, reach a predetermined amount, the yarns Y are transferred from the bobbin holder 7 to the bobbin holder 8 in the foregoing manner.

Similar steps take place whenever the amount of the packages wound on the bobbins inserted onto the bobbin holder reaches a predetermined amount.

During the normal winding operation, the winding is controlled as follows in the above-described embodiment.

The contact roller 15 is pressed against the packages 11 which are wound on the bobbins inserted onto the bobbin holder 7. The shaft of the contact roller 15 has the gear wheel 24 mounted thereon, and the rotational speed of the contact roller 15 is detected by the electro-magnetic pickup 25. The frequency of the inverter 22, which drives the motor 20, is regulated so that the rotational speed of the contact roller becomes a predetermined value.

When the knocker 28 hits the limit switch 26 due to the lifting movement of the slide block 3 caused by the increase of the amount of the packages 11 wound on the bobbin, the electro-magnetic relay 31 is closed. Then, the reduction device 29 with worm gear is driven, and the sprockets 38*a* and 38*b* are rotated. Accordingly, the slider 13, which has the bobbin holder 7 slidably mounted thereon and which is connected to the chain 38*c* by means of the joint 38*d*, is gradually lowered. When the knocker 28 disposed on the slide blocks 3 hits the limit switch 27, the reduction device 29 with worm gear is stopped.

The package 11 are wound by repetition of the above-described operation.

The reduction ratio of the reduction devices 30 and 29 with worm gear is so set that the bobbin holders, onto which packages are wound, do not lower because of the weight of the wound packages. Further, if the bobbin holders lower due to the weight of the packages, braking means may be added.

Figure 8B:
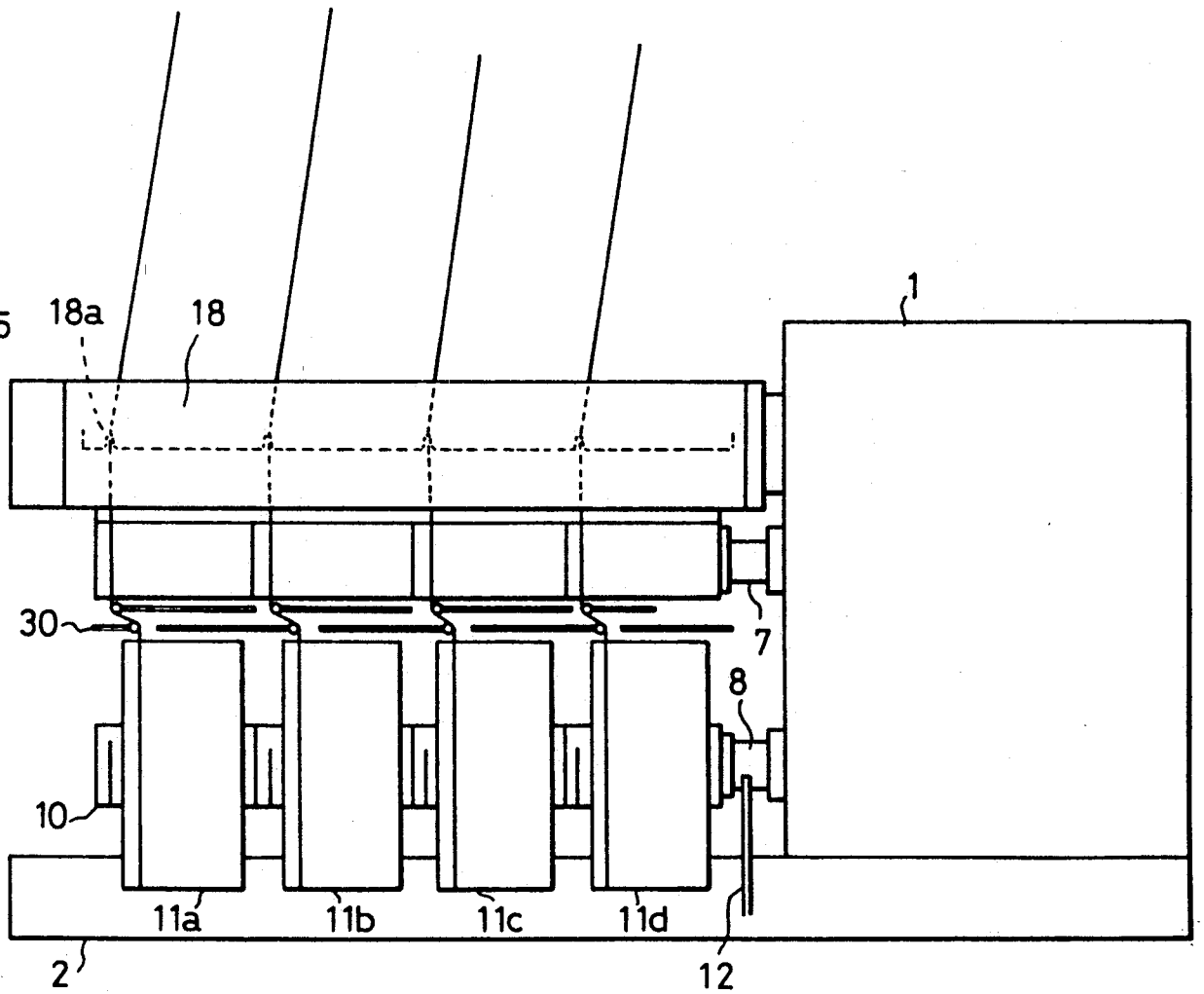
FIG. 8(*a*) is an elevation showing another embodiment of the present invention.
Figure 8A:
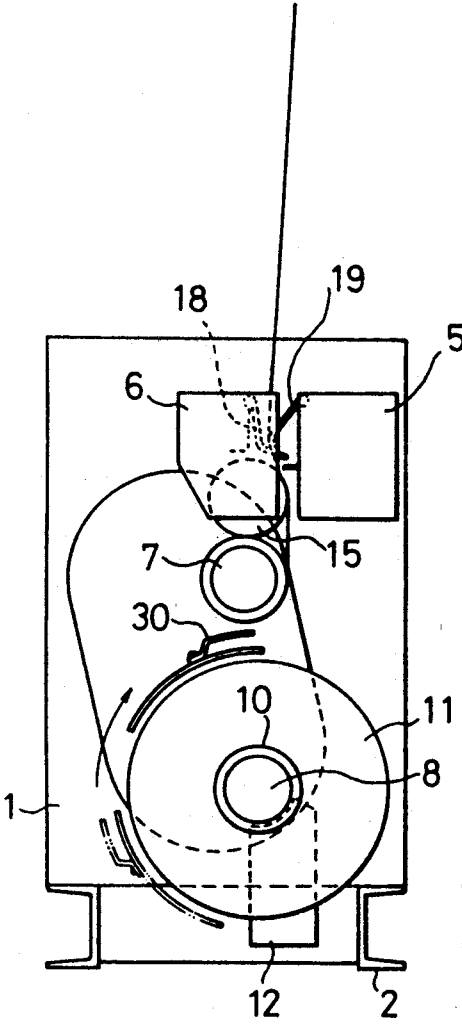

In the embodiment described above, the standing by bobbin holder is axially moved. However, a yarn regulating guide 30 may be inserted between the wound packages and the empty bobbins as illustrated in FIGS. 8(*a*) and 8(*b*).

Further, in the present embodiment, after the bobbin holder, onto which yarns are being wound, is moved to a portion illustrated in FIGS. 2(*a*), the standing by bobbin holder is moved to a position illustrated in FIGS. 3(*a*) and 3(*b*). However, if the standing by bobbin holder is moved when the distance between the packages and the contact roller exceeds a predetermined amount, for example, a diameter of the empty bobbin, the time required for the bobbin changing operation may be substantially the same regardless of the amount of the wound package. Thus, the changing efficiency at the small package can be enhanced. In this case, it is preferred that the moved distance of the reduction device with worm gear or the bobbin holder is detected, for example by an encoder.

Fluid pressure cylinders or the like may be used in place of the reduction devices with worm gear.

Although in the foregoing embodiment, a yarn winding apparatus of a spindle drive type is exemplified, the present invention may be applied to a yarn winding apparatus of a friction drive type. Further, although the locus formed by the movement of the bobbin holders is track shaped in the foregoing embodiment, the locus may be a circle, an ellipse, a triangle, a rectangle or the like.

Figure 9:
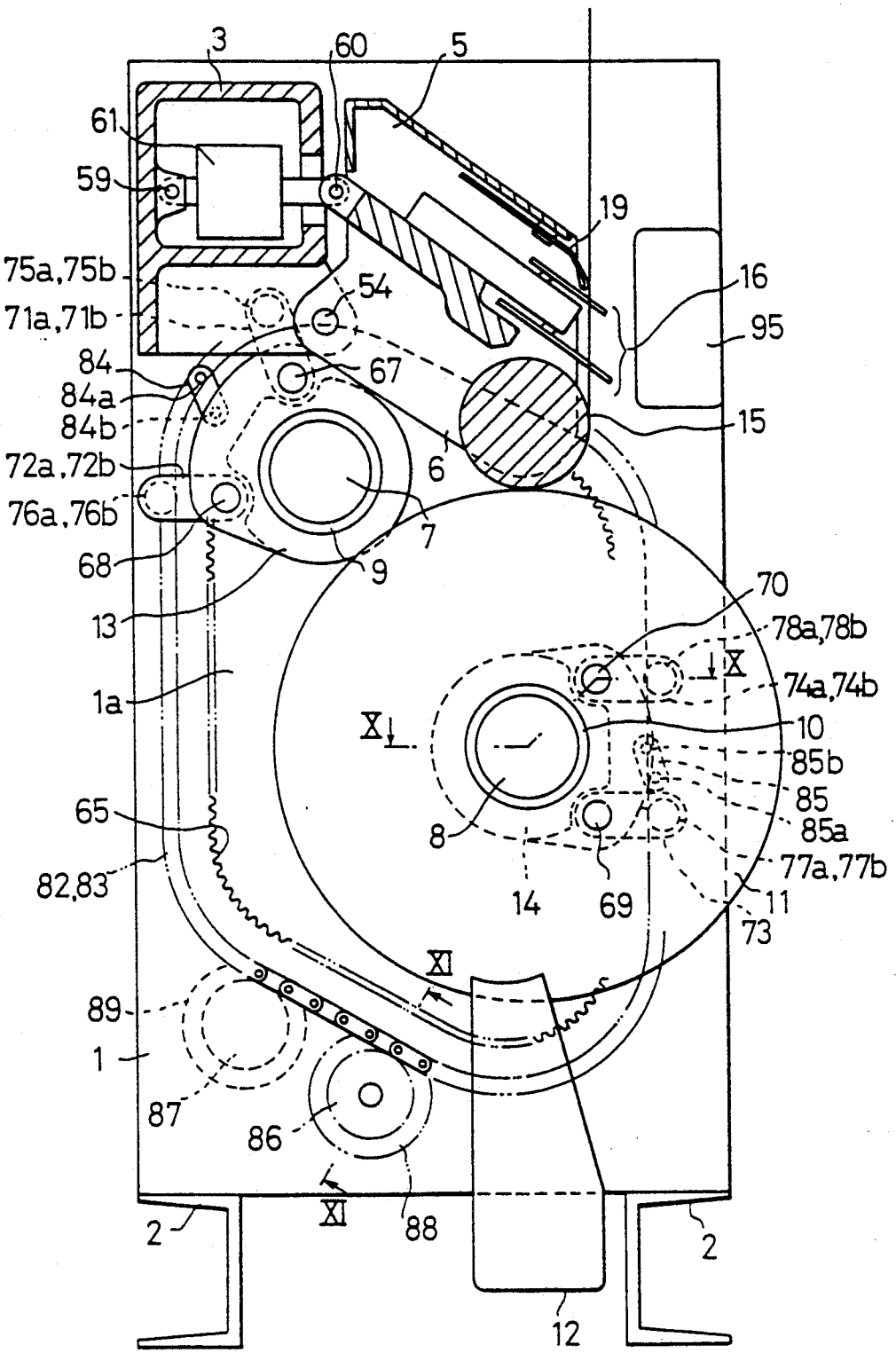
FIG. 9 is an elevation showing a further embodiment of the present invention.
Figure 10:
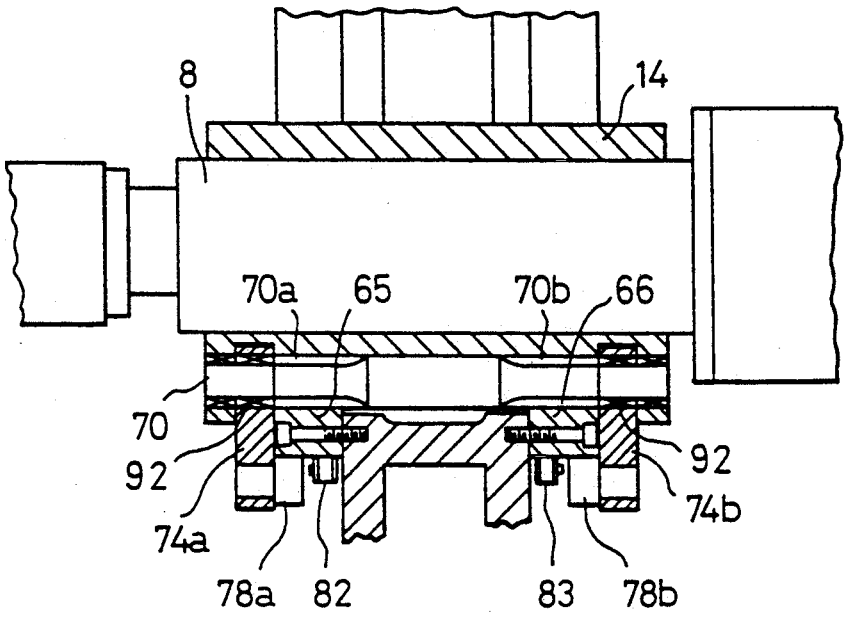
FIG. 10 is a cross sectional view taken along line X—X in FIG. 9.
Figure 11:
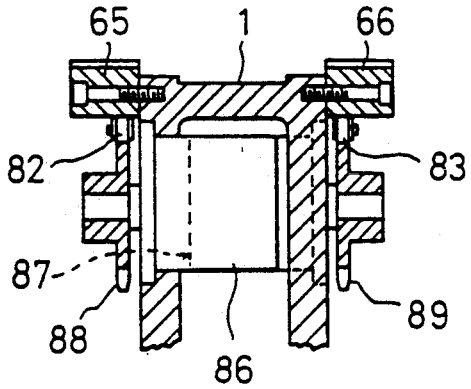
FIG. 11 is a cross sectional view taken along line XI—XI in FIG. 9.
Figure 12:
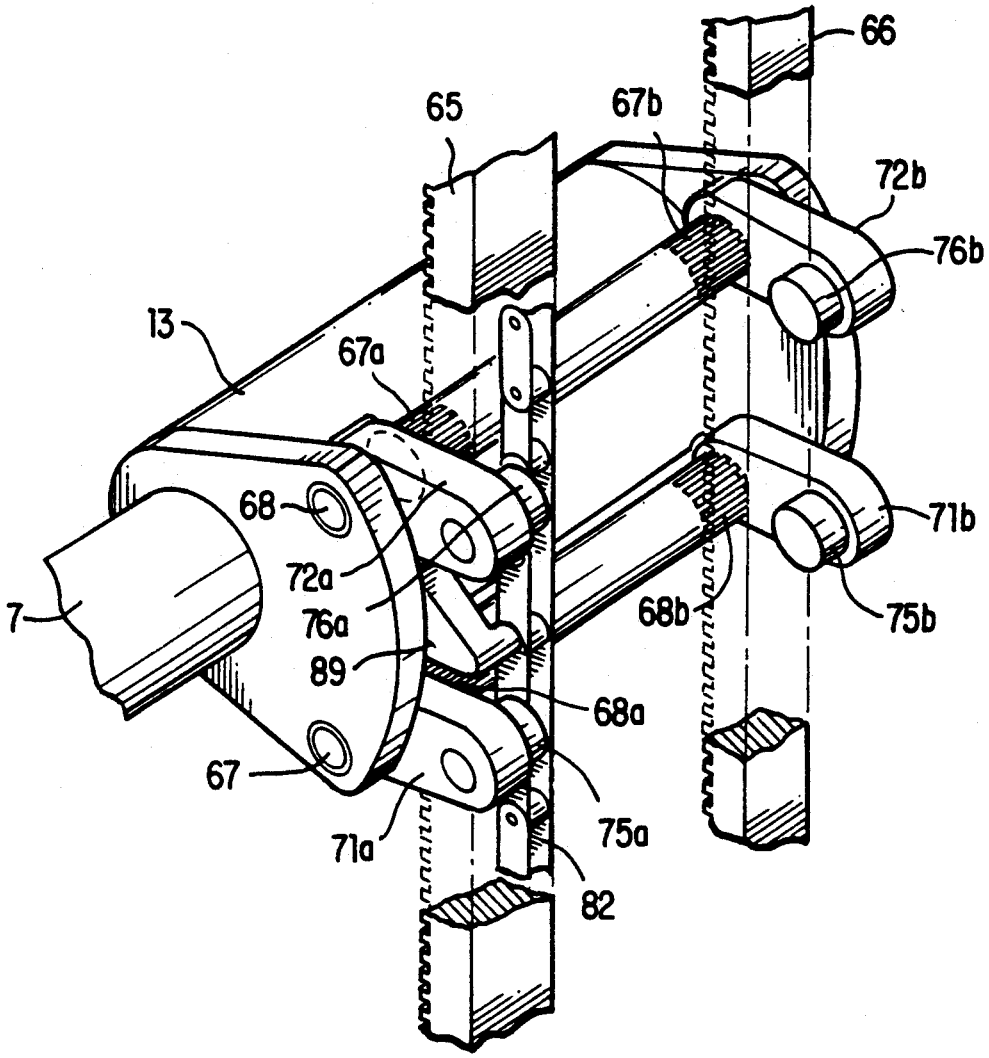
FIGS. 12 and 13 are perspective views of the sliders, bobbin holders, drive means, and gears of the embodiment shown in FIG. 9.
Figure 13:
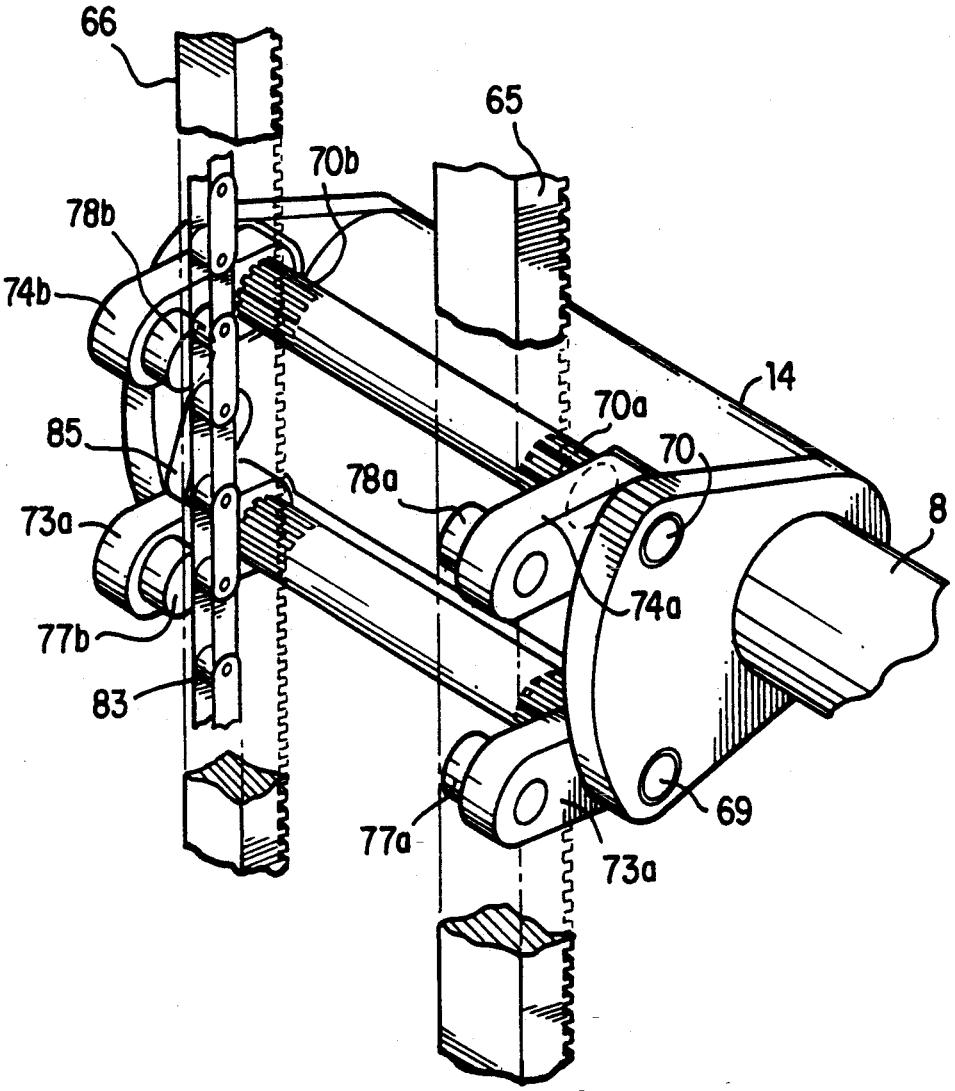
Figure 14:
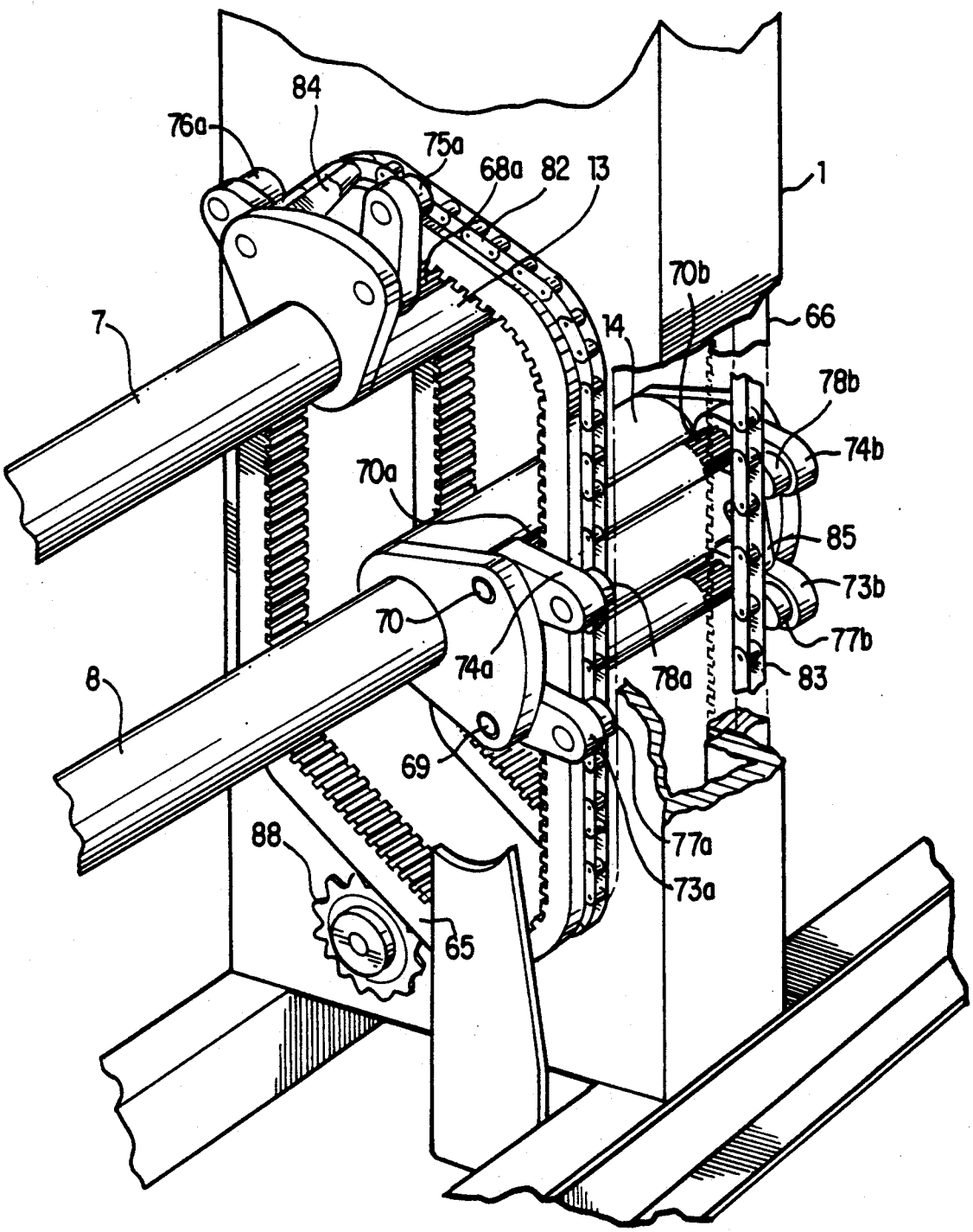
FIG. 14 is a perspective view of the machine frame opening with the bobbin holders projecting therethrough.

Another embodiment of the present embodiment will now be explained with reference to FIGS. 9 to 11. FIG. 9 is an elevation showing the embodiment, FIG. 10 is a cross sectional view taken along line X—X in FIG. 9, and FIG. 11 is a cross sectional view taken along line XI-XI in FIG. 9. FIGS. 12, 13 and 14 are perspective views of the sliders, bobbin holders, driven means, and gears of the embodiment in FIG. 9.

The construction of this embodiment now will be explained referring to FIGS. 9 to 13. The parts which are the same or similar to those in the embodiments, which have been explained with reference to FIGS. 1 to 7 and 8, are designated by the same reference numerals and their explanation is omitted.

Similar to the above-described embodiments, a machine steel frame 1 is disposed on a base 2 which comprises a pair of channels, and the machine frame 1 has a supporter 3 projecting therefrom. A frame 6 is supported swingably in a vertical direction about a pivot 54 mounted on the supporter 3, and the frame 6 has a traverse device 5 and a contact roller 15 mounted thereon. In this embodiment, the traverse device 5 comprises oppositely rotating rotary guides.

A bottom of a pneumatic cylinder 61 is connected to the hollow portion of the supporter 3 via a pin 59, and a piston rod of the pneumatic cylinder 61 is connected to the frame 6 via a pin 60. Accordingly, application of a predetermined amount of compressed air to the pneumatic cylinder 61 supports the weight of the frame 6, the contact roller 15 and the traverse device 5 and at the same time, the pneumatic cylinder 61 exerts a predetermined amount of contacting pressure between the contact roller 15 and the bobbin holder 7 or 8 onto which the yarns are being wound.

Bobbins 9 are inserted onto the bobbin holder 7, which is located at a stand-by position in FIG. 9, and bobbins 10 are inserted onto a bobbin holder 8, which is used to wind yarn packages 11, to form packages 11 onto the bobbins 10. Similar to the above-described embodiment, the bobbin holders 7 and 8 are driven by electric motors (not shown), respectively, which are controlled by a controller (not shown) in accordance with any known method so that the the rotational speed of the contact roller is maintained to a predetermined value.

The bobbin holder 7 is supported on a slider 13, and the bobbin holder 8 is supported on a slider 14.

After the bobbin holder 8, having fully wound packages 11 inserted thereon, is changed to the bobbin holder 7, having empty bobbins 9 inserted thereon, the bobbin holder 8 is moved to a position for doffing the packages 11 where a plate 12, which is capable of engagement with the bobbins 10 onto which the packages 11 are wound, is moved by a pneumatic cylinder (not shown) in parallel with the bobbin holder 8 so as to push out the packages 11.

The machine frame 1 has a hole la, which penetrates in an axial direction of the bobbin holders 7 and 8 and which is formed in a desired shape, for example, in a parallelogram with rounded edges in the illustrated embodiment. Inner gears 65 and 66 are spaced in an axial direction of the bobbin holders 7 and 8 and are disposed at the inner periphery of the hole 1*a* along a bobbin holders guiding path.

The slider 13 rotatably supports the ends of two shafts 67 and 68. The shaft 67 has gear wheels 67*a* and 67*b* formed thereon, and the shaft 68 has gear wheels 68*a* and 68*b* formed thereon, as illustrated in FIG. 12. Similarly, the slider 14 rotatably supports the ends of two shafts 69 and 70. The shaft 69 has gear wheels 69*a* and 69*b* formed thereon, and the shaft 70 has gear wheels 70*a* and 70*b*, formed thereon, as illustrated in FIGS. 10 and 13.

The gear wheels 67*a*, 68*a*, 69*a* and 70*a* engage with the inner gear 65, and the gear wheels 67*b*, 68*b*, 69*b* and 70*b* engage with the inner gear 66.

In FIGS. 10 and 13 the shaft 70 has a pair of arms 74*a* and 74*b* swingably mounted thereon via needle bearings 92, and the arms 74*a* and 74*b* have cam followers 78*a* and 78*b* at the ends thereof, respectively, so that the cam followers 78*a* and 78*b* are spaced from the shaft by a predetermined distance. Similarly, as illustrated in the shaft 67 has a pair of arms 71*a* and 71*b* pivoted thereto, and the arms 71*a* and 71*b* have cam followers 75*a* and 75*b*, respectively, attached thereto. Further, the shaft 68 has a pair of arms 72*a* and 72*b* pivoted thereto, and the arms 72*a* and 72*b* have cam followers 76*a* and 76*b*, respectively, attached thereto. In addition, the shaft 69 has a pair of arms 73*a* and 73*b* pivoted thereto, and the arms 73*a* and 73*b* have cam followers 77*a* and 77*b*, respectively, attached thereto.

The cam followers 75*a*, 76*a*, 77*a* and 78*a* engage with the outer periphery, i.e., the surface opposite to the gears, of the member, wherein the inner gear 65 is formed. Similarly, the cam followers 75*b*, 76b, 77*b* and 78*b* engage with the outer periphery, i.e., the surface opposite to the gears, of the member, wherein the inner gear 66 is formed.

Thus, the gear wheels 67*a*, 68*a*, 69*a* and 70*a* and the cam followers 75*a*, 76*a*, 77*a* and 78*a* sandwich the inner gear 65, and the gear wheels 67*b*, 68*b*, 69*b* and 70*b* and the cam followers 75*b*, 76*b*, 77*b* and 78*b* sandwich the inner gear 66. As a result, the sliders 13 and 14 can move along the outer peripheries of the inner gears 65 and 66.

Further, an endless chain 82 is disposed around the outer periphery of the member for the inner gear 65 (see FIGS. 10 and 12), and the endless chain 82 and the slider 13 are connected to each other by a connecting piece 84 and pins 84*a* and 84*b* (see FIG. 9). Similarly, an endless chain 83 is disposed around the outer periphery of the member for the inner gear 66 (see FIGS. 10 and 13), and the endless chain 83 and the slider 14 are connected to each other by a connecting piece 85 and pins 85*a* and 85*b* (see FIG. 9).

Referring to FIG. 9, a servo motor 86 is disposed on the machine frame 1, and a sprocket 88 attached to the spindle of the servo motor 86 engages with the endless chain 82. As a result, as the servo motor 86 rotates, the endless chain 82 is moved, and the slider 13 is also moved along the inner gears 65 and 66.

Similarly, as illustrated in FIG. 9, a servo motor 87 is disposed on the machine frame 1 and has a sprocket 89 attached to the spindle thereof, which engages with the endless chain 83. As a result, as the servo motor 87 rotates, the endless chain 83 is moved so that the slider 14 is also moved along the inner gears 65 and 66.

A guide device 95 is disposed at a position opposite to the traverse device 5 in FIG. 9, and the guide device 95 serves to hold the yarns Y, which have been disengaged from the guide 16 of the traverse device 5, at positions adjacent to the ends of the bobbins 9 and 10 upon bobbin changing operation so that transfer tails are formed. Since such a guide device 95 is conventionally known, the explanation of the detailed construction is omitted here.

Operation of this embodiment will now be explained. The operation is performed by a controller (not shown) which accommodates a computer (CPU).

During a normal winding operation, the packages 11 are formed on the bobbins 10 inserted onto the bobbin holder 8, and when the contact roller 15, which is pressed against the packages 11, is moved upwardly by a small distance and switches on a limit switch (not shown), the servo motor 87 starts. As a result, the bobbin holder 8 is lowered, and the servo motor 87 stops when the limit switch is switched off. The foregoing operation is repeated as the amount of the wound packages increases.

When the packages 11 reach a predetermined amount, the rotation of the standing by bobbin holder 7 is started. When the rotational speed of the bobbin holder 7 reaches a predetermined speed, the servo motor 87 is started so that the bobbin holder 8 having fully wound packages is lowered and so that the fully wound packages are disengaged from the contact roller 15 and kept at a predetermined position.

When the distance between the bobbin holder 8 and the contact roller 15 becomes a predetermined value during the movement of the bobbin holder 8, for example, when the distance between the outer periphery of the bobbin holder 8 and the outer periphery of the contact roller 15 is equal to an outer diameter of an empty bobbin in this embodiment, the yarn disengaging guide 19 is moved to the right in FIG. 9 by means of a pneumatic cylinder (not shown), and the yarns Y are disengaged from the traverse device 5. Then, while the yarns Y are kept at positions corresponding to the yarn catching means in accordance with a known manner by utilizing the guide device 95, the yarns Y are wound onto the packages 11 at positions near their shoulders. The yarn catching means is grooves formed at the peripheries of the bobbins 10 inserted onto the bobbin holder 8 in this embodiment, however, another means may be applicable.

Thereafter, when the servo motor 86 is started to move the bobbin holder 7 to the right in FIG. 9, the yarns Y are caught by the yarn catching means, and then, after the bobbin holder reaches a predetermined position, the rotation of the servo motor 86 is stopped. During this operation, bunch windings of a slight amount are formed near the yarn catching means.

Then, transfer tails are formed on the bobbins 9 by means of the cooperation between the guide device 95 and the axial movement of the bobbin holder 7. After completion of the axial movement of the bobbin holder 7, the yarns Y are released from the guide device 95 and are traversed by the traverse device 5.

As the amount of the packages (not shown), which are wound on the bobbins 9 inserted onto the bobbin holder 7, increases, the contact roller 15, which is pressed against the packages (not shown) slightly moves upwardly, the limit switch (not shown) is switched on in a manner similar to that described above, and then, the servo motor 86 is started so as to lower the bobbin holder 7, and the servo motor 86 is stopped when the limit switch is switched off.

Similar steps take place as the amount of the packages (not shown) wound on the bobbins inserted onto the bobbin holder 7 increases. The wound packages 11 located at the doffing position are pushed out by the plate 12 before the diameter of the packages reaches a predetermined amount, and empty bobbins 10 are donned onto the bobbin holder 8.

Then, the slider 14 supporting the bobbin holder 8 is lifted to a stand by position by the servo motor 87 and stops there. The standing by bobbin holder 8 waits at this position until the amount of the yarns wound on the bobbin holder 7 reaches a predetermined value, and then, the rotation of the bobbin holder 8, which has stood by, is started, and the operation similar to that described above is repeated.

As it is clear from the foregoing explanation, two bobbin holders are circulated in a minimum and indispensable space according to the present invention, the distance between adjacent winding apparatus can be smaller compared with a conventional winding apparatus of a turret type. Further, the bobbin holders can be supported in precisely parallel with the contact roller with a high rigidity, and accordingly, the vibration of the bobbin holder during the winding operation can be minimized.

Although an inner gear, i.e., a member with internal gear, is used as an endless gear member in this embodiment, an outer gear, i.e., a member with external gear may be used for the endless gear member. Further, in place of the inner gear of this embodiment, an endless chain, an endless teethed belt or the like may be fixed to the machine frame so that the bobbin holders circulate along a path formed in a closed loop while they are engaging with the endless chain, the endless teethed belt or the like.

Although the two bobbin holders are circulated in a direction opposite to the rotational direction of the bobbin, they may be circulated in a direction the same as the rotational direction of the bobbin.

According to the present invention, since a plurality of bobbin holders can be moved independently along the bobbin holders guiding path, the space required for installation of the winding apparatus is a sum of a diameter of fully wound package and a diameter of an empty bobbin, and thus, the required space can be about $\frac{3}{4}$ of that required for a conventional yarn winding apparatus of a turret type.

Further, when the present invention is applied to an automatic bobbin changing yarn winding apparatus provided with a contact roller connected to no driving source, a stand-by bobbin holder can be located near the contact roller previous to the changing operation, since a bobbin holder having an empty bobbin mounted thereonto can be moved independently from another bobbin holder having a fully wound package mounted thereon. Therefore, the time, which is required between the relief of a fully wound package from a contact roller and the contact of an empty bobbin to the contact roller, can be shortened. As a result, the rotational speed of the contact roller can be kept at a substantially constant speed during the changing operation, and the control of the winding apparatus can be improved during the bobbin changing operation.

Furthermore, since a plurality of bobbin holders can be independently moved according to the present invention, the angle formed by the yarn contacting with an empty bobbin can be smaller compared with that in the conventional bobbin winding apparatus of a turret type, while the direction of the peripheral speed of an empty roller is opposite to the yarn running direction. Accordingly, the yarn can be prevented from being slack at a high speed, and fluffs in the yarn can be minimized, and further, bobbin changing efficiency can be enhanced.

In addition, when the endless gear member is disposed on the machine frame and a plurality of sliders which can engage with the endless gear member are disposed so that the bobbin holders supported on the sliders can be independently moved along the endless gear member, as shown in the last embodiment of the present invention, the bobbin holders can be supported in precisely parallel with the contact roller with a high rigidity, and accordingly, the vibration of the bobbin holders during the winding operation can be minimized.

I claim:

1. A yarn winding apparatus of an automatic bobbin changing type, which is provided with a plurality of bobbin holders, and in which when a package wound on one of said bobbin holders becomes a predetermined amount, winding of said yarn is changed to another bobbin holder, wherein said yarn winding apparatus comprises:

an opening formed on a machine frame of the yarn winding apparatus;

means forming a non-circular guiding path contained within said opening in the machine frame;

said bobbin holders penetrating through the opening so as to move along a closed loop along the non-circular guiding path along a winding position, a doffing position, an empty bobbin donning position, a stand-by position, a changing position and said winding position; and a means for independently moving said plurality of bobbin holders along said non-circular bobbin holders guiding path.

2. A yarn winding apparatus of an automatic bobbin changing type according to claim 1 wherein endless gear means are provided on said machine frame along said bobbin holders guiding path, said endless gear means engaging with gears disposed on supports of said plurality of bobbin holders for following movement of said plurality of bobbin holders.

3. A yarn winding apparatus of an automatic bobbin changing type according to claim 2, wherein a plurality of said endless gear means are spaced in a direction of axes of said plurality of bobbin holders, and said supports of said plurality of bobbin holders have a plurality of gears engaging with said plurality of said endless gear means.

4. A yarn winding apparatus of an automatic bobbin changing type according to claim 3, wherein said moving means includes a plurality of endless drive means spaced in a direction of said axes of said plurality of bobbin holders and disposed along said bobbin holders guiding path formed in a closed loop, each of said plurality of endless drive means being connected to each of said plurality of bobbin holder, respectively.

5. A yarn winding apparatus of an automatic bobbin changing type according to claim 4, wherein said plurality of endless drive means are chains and said chains are driven by motors.

6. A yarn winding apparatus of an automatic bobbin changing type according to claim 2, wherein said moving means includes a plurality of endless drive means spaced in a direction of axes of said plurality of bobbin holders and disposed along said bobbin holders guiding path formed in a closed loop, each of said plurality of endless drive means being connected to each of said plurality of bobbin holders, respectively.

7. A yarn winding apparatus of an automatic bobbin changing type according to claim 6, wherein said plurality of endless drive means are chains and said chains are driven by motors.

8. A yarn winding apparatus of an automatic bobbin changing type, which is provided with a plurality of bobbin holders, and in which when a package wound on one of said bobbin holders becomes a predetermined amount, winding of said yarn is changed to another bobbin holder, wherein said yarn winding apparatus comprises:

a machine frame;

endless gear means provided on said machine frame defining a non-circular guiding path for guiding said plurality of bobbin holders along a winding position, a doffing position, an empty bobbin donning position, a stand-by position, a changing position and said winding position;

means for moving said plurality of bobbin holders along said non-circular guiding path; and said endless gear means engaging with gears disposed on supports of said plurality of bobbin holders so that said plurality of bobbin holders can be moved along said endless gear means.

9. A yarn winding apparatus of an automatic bobbin changing type according to claim 8, wherein a plurality of said endless gear means are spaced in a direction of axes of said plurality of bobbin holders, and said supports of said plurality of bobbin holders have a plurality of gears engaging with said plurality of endless gear means.

10. A yarn winding apparatus of an automatic bobbin changing type according to claim 9, wherein said moving means includes a plurality of endless drive means spaced in a direction of said axes of said plurality of bobbin holders and disposed along said noncircular guiding path, each of said plurality of endless drive means being connected to each of said plurality of bobbin holders for moving said plurality of bobbin holders.

11. A yarn winding apparatus of an automatic bobbin changing type according to claim 10 wherein said plurality of endless drive means are chains and said chains are driven by motors.

12. A yarn winding apparatus of an automatic bobbin changing type according to claim 8, wherein said moving means includes a plurality of endless drive means spaced in a direction of said axes of said plurality of bobbin holders and disposed along said bobbin holders guiding path formed in a closed loop, each of said plurality of endless drive means engaging each of said plurality of bobbin holders, respectively.

13. A yarn winding apparatus of an automatic bobbin changing type according to claim 12, wherein said plurality of endless drive means are chains and said chains are driven by motors.

* * * * *

UNITED STATES PATENT AND TRADEMARK OFFICE

CERTIFICATE OF CORRECTION

PATENT NO. : 5,246,177

DATED : September 21, 1993

INVENTOR(S) : Takami Sugioka

It is certified that error appears in the above-indentified patent and that said Letters Patent is hereby corrected as shown below:

Col. 4, line 2, after "4b" insert --(see--.

Col. 4, line 60, after "slider" insert --13 is controlled by the cam follower 13a to a predetermined--.

Col. 6, line 59, "package" should be --packages--.

Col. 7, line 6, after "2(a)" insert --and 2(b)--.

Col. 7, line 44, delete "steel".

Col. 7, line 45, after "pair of" insert --steel--.

Col. 8, line 42, after "illustrated in" insert --Figs. 9 and 12,--.

Col. 11, line 64, "following" should be --allowing--.

Col. 12, line 61, "noncircular" should be --non-circular--.

Signed and Sealed this

Twenty-sixth Day of April, 1994

Bruce Lehman

*Attest:*

BRUCE LEHMAN

*Attesting Officer*

*Commissioner of Patents and Trademarks*